US006845958B2

(12) United States Patent
Wood et al.

(10) Patent No.: US 6,845,958 B2
(45) Date of Patent: Jan. 25, 2005

(54) WIRELINE VALVE ACTUATOR

(75) Inventors: Carl Richard Wood, Aberdeenshire (GB); Kenneth Steven Coull, Aberdeenshire (GB)

(73) Assignee: Elmar Services Limited, Aberdeen (GB)

( * ) Notice: Subject to any disclaimer, the term of this patent is extended or adjusted under 35 U.S.C. 154(b) by 122 days.

(21) Appl. No.: 10/233,986

(22) Filed: Sep. 3, 2002

(65) Prior Publication Data

US 2003/0075699 A1 Apr. 24, 2003

(30) Foreign Application Priority Data

Sep. 3, 2001 (GB) ..... 0121277

(51) Int. Cl.[7] ..... E21B 33/06
(52) U.S. Cl. ..... 251/1.1; 251/1.3
(58) Field of Search ..... 251/1.1–1.3

(56) References Cited

U.S. PATENT DOCUMENTS 3,647,174 A * 3/1972 LeRouax ..... 251/1.3
3,670,761 A * 6/1972 Lerouax ..... 137/315.02
3,871,613 A * 3/1975 LeRouax ..... 251/1.3
4,214,605 A 7/1980 Hardgrave
4,519,571 A * 5/1985 Jones et al. ..... 251/1.3
4,638,972 A 1/1987 Jones et al.
4,877,217 A 10/1989 Peil et al.
5,287,879 A 2/1994 Leggett et al.

FOREIGN PATENT DOCUMENTS

GB 2112837 12/1982

OTHER PUBLICATIONS

Koomey Inc. vol 4, J–Line, Blowout Preventers, p. 4 (1986).

* cited by examiner

*Primary Examiner*—Paul J. Hirsch
(74) *Attorney, Agent, or Firm*—Drinker Biddle & Reath LLP

(57) ABSTRACT

A wireline valve/blowout preventor is capable of resisting the flow of fluids through a bore. At least one actuator assembly has a first and second end moveable between a first configuration in which fluids can flow through the bore, and a second configuration in which fluids flow through the bore is prevented. The first and second ends are each exposed to the pressure in the bore. A biasing arrangement may bias the actuator assembly toward one of the first and second configurations. A locking member may also be provided to abut with the actuator assembly when it is in the second configuration in order to prevent movement of the actuator assembly from the second configuration to the first configuration. Also, the actuator assembly may have at least one rod assembly which extends from the actuator assembly to a position where it is visible from an outside of the apparatus.

14 Claims, 8 Drawing Sheets

WIRELINE VALVE ACTUATOR

FIELD OF THE INVENTION

This invention relates to a wireline valve and particularly but not exclusively to an actuator assembly for a wireline valve used to seal off wirelines, measuring or slick lines and deployment bars as used in the oil and gas industry. These wireline valves are commonly known in the industry as wireline Blow-Out Preventors (BOPs).

BACKGROUND OF THE INVENTION

Wireline BOPs are provided for oil and gas wells in order to seal off the wellbore. Typically, wireline BOPs comprise one or more pairs of actuators which are hydraulically activated to close the well, resisting the well fluids and thereby preventing well blow-out. The rams are then locked in position by a secondary means which may comprise a threaded stem or a tapered wedge.

SUMMARY OF THE INVENTION

According to a first aspect of the present invention there is provided an apparatus capable of resisting the flow of fluids through a bore, the apparatus including at least one actuator assembly, the or each actuator assembly having a first and second end and being adapted to move between a first configuration wherein fluids are permitted to flow through the bore, and a second configuration wherein fluids are resisted from flowing through the bore, wherein the first and second ends are each exposed to the pressure in the bore; the apparatus further comprising a biasing arrangement adapted to bias the actuator assembly toward one of the first and second configurations.

Preferably, the biasing arrangement comprises a piston with a first end and a second end, each end being sealed within a cylinder by first and second sealing mechanisms, and wherein the first sealing mechanism provides a smaller cross sectional sealing area than the second sealing means.

According to a second aspect of the present invention there is provided an apparatus capable of resisting the flow of fluids through a bore, the apparatus including at least one actuator assembly, the or each actuator assembly having a first and second end and being adapted to move between a first configuration wherein fluids are permitted to flow through the bore, and a second configuration wherein fluids are resisted from flowing through the bore, wherein the first and second ends are each exposed to the pressure in the bore and wherein a locking member is provided to abut with the actuator assembly when it is in the second configuration in order to resist movement of the actuator assembly from the second configuration to the first configuration.

Preferably, the locking member is threadably engaged on a cylinder.

Preferably, the cylinder is of varying diameter. Typically, the locking member is provided on a portion of the cylinder which is smaller in diameter than the portion of the cylinder from which rods extend.

Preferably, a sleeve is threadably mounted on the locking member and can be rotated in a first direction to engage a further portion of the cylinder or in a second direction to cause movement of the locking member toward the actuator assembly.

Preferably, the locking member has an internal thread and an external thread, said internal thread being oppositely directed to said external thread.

According to a third aspect of the invention, there is provided an apparatus capable of resisting the flow of fluids through a bore, the apparatus including at least one actuator assembly, the or each actuator assembly having a first and second end and being adapted to move between a first configuration wherein fluids are permitted to flow through the bore, and a second configuration wherein fluids are resisted from flowing through the bore, wherein the first and second ends are each exposed to the pressure in the bore and wherein the actuator assembly comprises at least one rod which extends from the actuator assembly to a position in which it is visible from an outside of the apparatus.

This aspect of the invention has the advantage that the outwardly visible rod demonstrates to an operator the degree of movement of the actuator assembly between the first and second configuration.

Preferably, there are a plurality of rods such as three rods. Preferably, the rods extend through apertures provided in the cylinder.

Preferably, a first end of the or each rod is attached to the actuator assembly and a second end of the or each rod is adapted to abut with a locking member such as the locking member of the second aspect of the invention.

Preferably, the or each actuator assembly is provided in a cylinder, and the cylinder comprises a hydraulic fluid chamber and a bore pressure chamber.

Preferably, the pressure in the bore and the pressure in the bore pressure chamber are equal.

Preferably, the actuator assembly comprises first and second hydraulic fluid chambers, wherein hydraulic fluid may be injected into either one of the first and second hydraulic fluid chambers to move the actuator assembly from the second configuration to the first configuration or from the first configuration to the second configuration respectively.

Preferably, the actuator assembly comprises a piston and a flange extends radially from the piston to separate the first and second hydraulic fluid chambers.

Typically, hydraulic fluid pressure may act on a first face of the flange, and may act on a second opposite face of the flange. The cross-sectioned area of the first and second faces of the flange upon which the pressure of the bore can act may be the same or may differ.

Preferably, the or each actuator assembly comprises a throughbore closure device provided at its first end.

Preferably, a channel is provided in the or each actuator assembly so that the bore is in fluid communication with the bore pressure chamber. More preferably, the channel extends through the piston.

Preferably, the or each actuator assembly is hydraulically activated.

To activate the or each actuator assembly, hydraulic fluid is typically injected into the hydraulic fluid chamber on one side of the flange and acts upon the flange of the piston to push the or each actuator assembly from the open configuration to the closed configuration.

Preferably, the locking member is then moved, typically by rotation, towards and the bore until further movement is resisted by the locking member abutting against the rod(s). This typically provides the secondary means to hold the actuator assembly in the closed configuration.

Preferably, the or each actuator assembly may also be moved from the closed configuration to the open configuration. To achieve this, the locking member is preferably moved, typically by rotation, in the opposite direction thereby disengaging the rods from the locking member. Preferably, hydraulic fluid is then injected into the first hydraulic fluid chamber typically provided on the opposite side of the flange of the piston. The hydraulic fluid typically acts on the opposite side of the flange in so doing moving the or each actuator assembly from the closed configuration to the open configuration.

Preferably, the sleeve is moved in order to activate the locking member to secure the actuator assembly in the second configuration.

Preferably, the sleeve may engage a portion of the cylinder in order to cover and/or protect the rods extending through the apertures of the cylinder. This is normally only necessary during transit of the apparatus.

Preferably, the apparatus comprises a pair of actuator assemblies adapted to engage with each other to resist flow of fluid through the wellbore when in their closed configuration. Optionally, there may be two or more pairs of actuator assemblies in order to resist flow of fluid through the wellbore at two distinct points.

According to a fourth aspect of the present invention there is provided an apparatus capable of resisting the flow of fluids through a bore, the apparatus including at least one actuator assembly, the or each actuator assembly having a first and second end and being adapted to move between a first configuration wherein fluids are permitted to flow through the bore, and a second configuration wherein fluids are resisted from flowing through the bore, wherein pressure in the bore is exposed to the first end of the actuator assembly and characterised in that a mechanism is provided to vary the pressure at the second end of the actuator assembly.

Typically, the mechanism is provided to vary the pressure balance at the second end of the actuator assembly with respect to the first end of the actuator assembly.

According to a fifth aspect of the present invention there is provided an actuator assembly for use with an apparatus capable of resisting the flow of fluids through a bore, the actuator assembly having a channel extending from a first to a second end.

Preferably, the actuator assembly is the actuator assembly used with the apparatus according to the any previous aspect of the invention.

BRIEF DESCRIPTION OF THE DRAWINGS

An embodiment of the invention will now be described by way of example only with reference to the accompanying drawings wherein:

FIG. 9(*b*) is a first cross-sectional view of the cylinder of FIG. 9(*a*) through section A—A;

FIG. 9(*c*) is a second cross-sectional view of the cylinder of FIG. 9(*d*) through section C—C;

FIG. 9(*d*) is an inner end view of the cylinder of FIG. 9(*a*); and

FIG. 9(*e*) is a cross-sectional view of the cylinder of FIG. 9(*a*) through section B—B.

DESCRIPTION OF PREFERRED EMBODIMENTS

Figure 1:
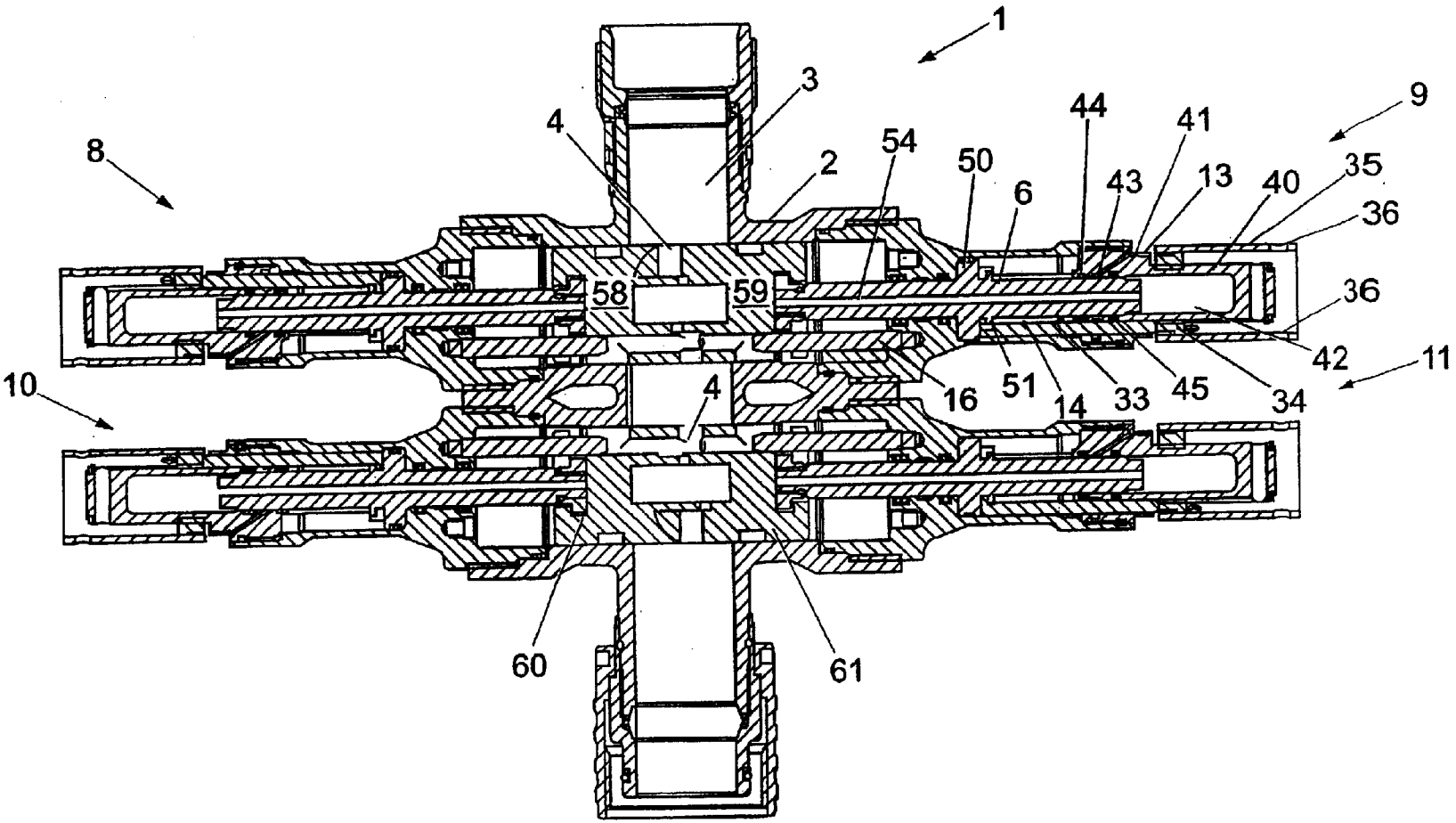
FIG. 1 is a sectional view of a wireline blow-out preventor (wireline BOP), in a closed configuration, according to the present invention.
Figure 2:
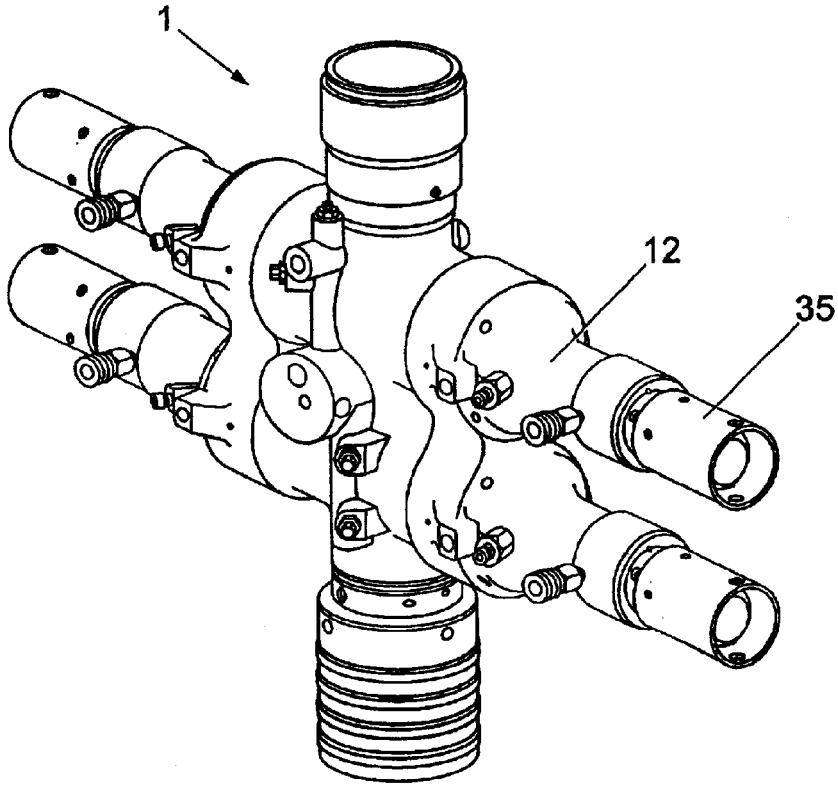
FIG. 2 is a perspective view of the wireline BOP of FIG. 1.

FIG. 1 shows a wireline BOP 1 as comprising four arms 8, 9, 10, 11 and a body 2 comprising a vertically arranged throughbore 3. The wireline BOP 1 is normally placed at a wellhead (not shown) and can be activated to resist blow out of the well, as described below.

Figure 6:
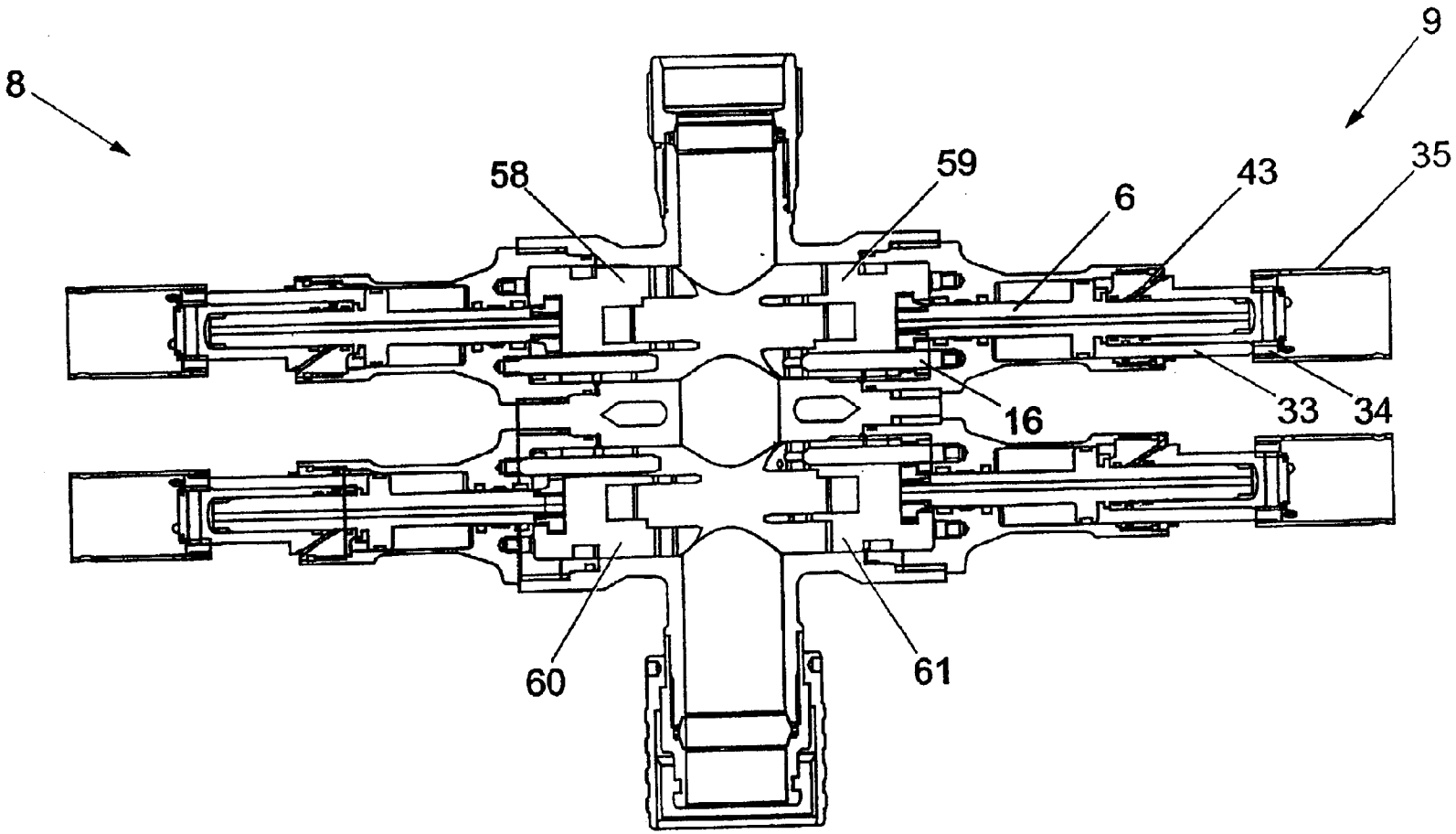
FIG. 6 is a sectional view of the wireline BOP of FIG. 1, in an open configuration.
Figure 7:
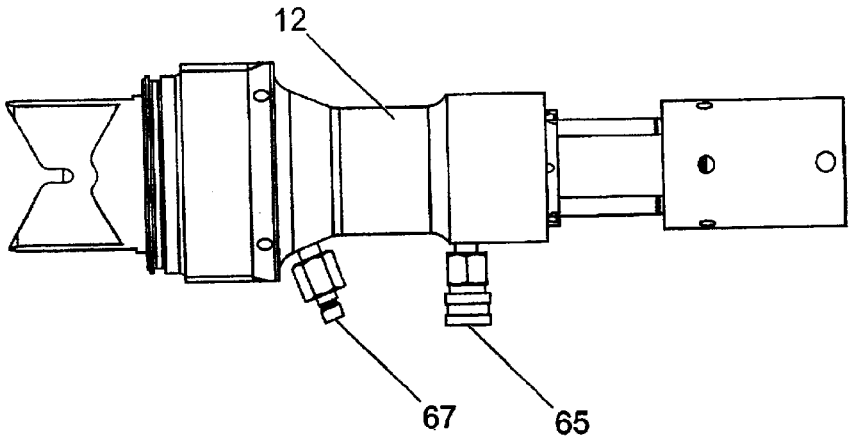
FIG. 7 is a top view of the actuator assembly of FIG. 3.
Figure 8:
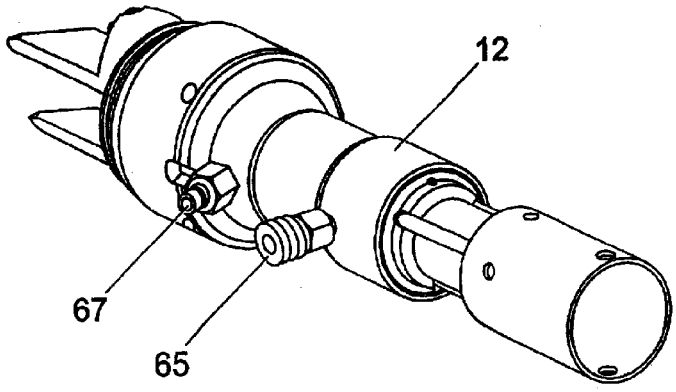
FIG. 8 is a perspective view of the actuator assembly of FIG. 3.
Figure 9E:
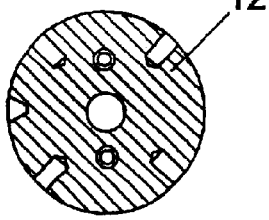
FIG. 9(*a*) is a side view of the cylinder of FIG. 3.
Figure 9A:
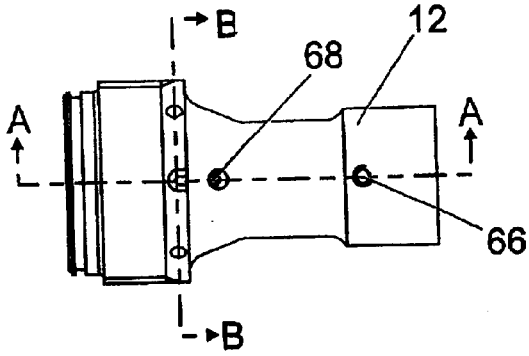
Figure 9D:
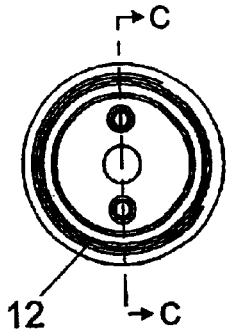
Figure 9B:
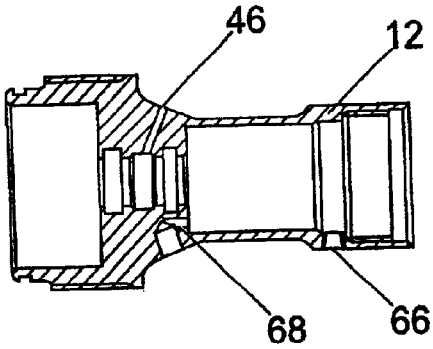
Figure 9C:
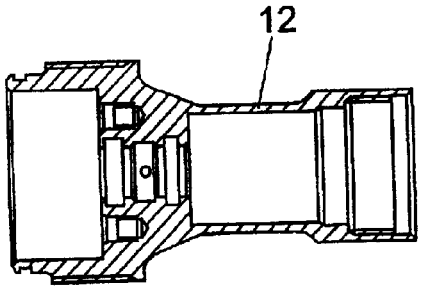

In each arm 8–11 there is provided an actuator assembly including rams 58–61 in accordance with the present invention. The rams 58, 59 of the arms 8, 9 are provided opposite each other and are adapted to move from an open configuration as shown in FIG. 6 to a closed configuration as shown in FIG. 1, insodoing engaging each other and closing the throughbore 3 of the body 2. Normally, a small aperture 4 is provided in the rams 58, 59 in order to allow a wireline (not shown) extending through the bore 3 to remain in place and be largely unaffected by the closure of the rams 58, 59. Seals (not shown) are provided on the rams 58-61 in order to seal around the wireline and also to seal the wellbore.

The rams 60, 61 of the arms 10, 11 operate as described above for the rams 58, 59. Therefore the bore 3 is sealed by two pairs of rams 58 & 59, 60 & 61, the pairs operating independently of each other. Moreover, the features and operations of each actuator assembly are common to all and are hereafter described with reference to the actuator assembly provided in the second arm 9 and best shown in FIG. 3.

The actuator assembly of the second arm 9 includes the ram 59 which is supported by a guide 16. The rearmost face of the ram 59 is attached to the forward end of a piston 6 which extends through a first bore or chamber 14 of a cylinder 12 into a second bore 42 of a housing 40. The first bore 14 can be considered as a hydraulic fluid chamber 14, and the second bore 42 can be considered as a wellbore pressure chamber 42.

A first piston flange 50 extends radially outwardly from the piston 6 into hydraulic fluid chamber 14, to support the piston 6 in the bore 14 of the cylinder 12, and with the aid of an 'O' ring seal 52, seals the piston flange 50 with respect to the inner surface of the cylinder 12.

Figure 4:
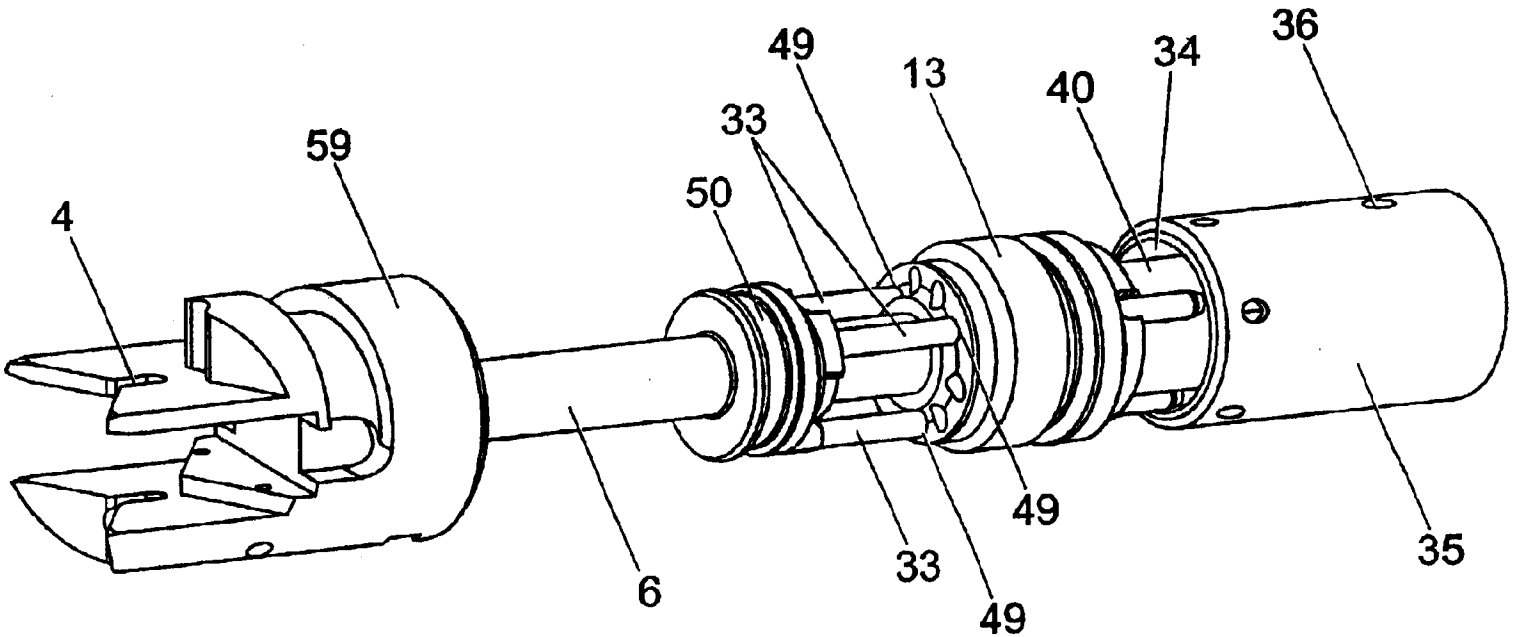
FIG. 4 is a perspective view of an actuator assembly (with ram body seals and cylinder omitted) of the wireline BOP of FIG. 1.
Figure 5:
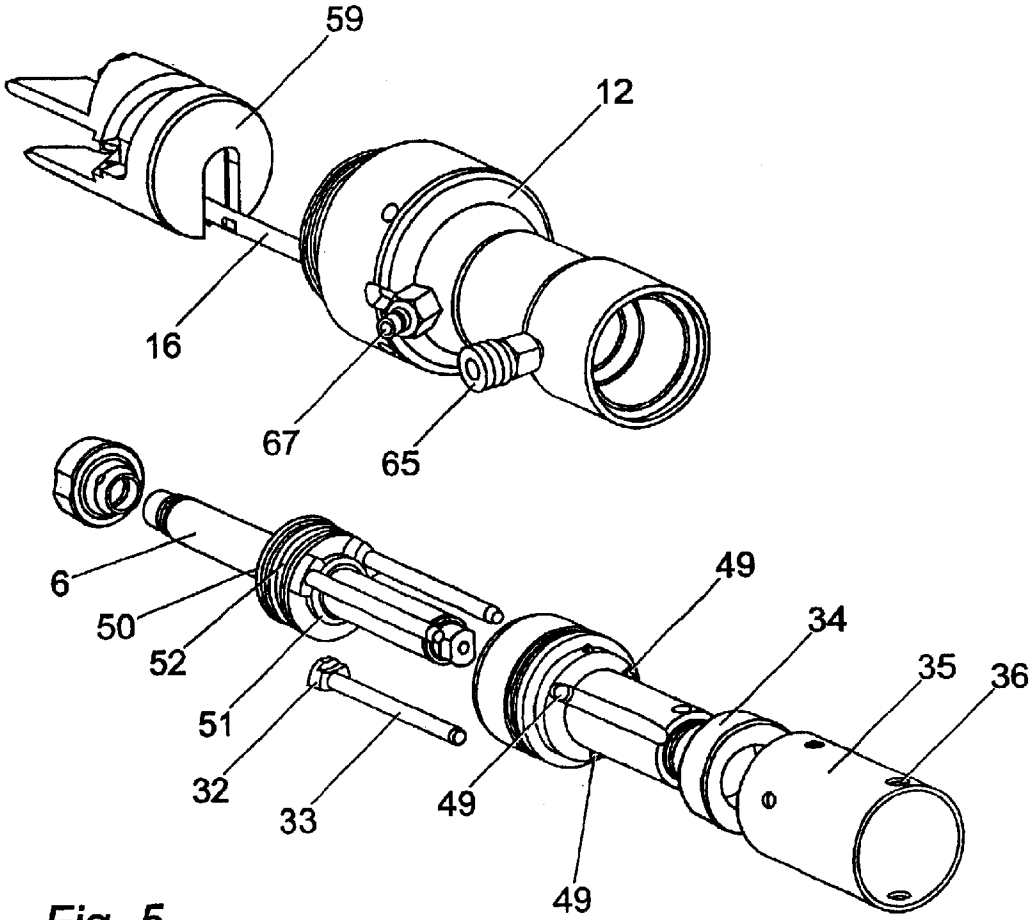
FIG. 5 is an exploded view of the actuator assembly of the wireline BOP of FIG. 1.

A second, smaller diameter piston flange 51 also extends radially outwardly from the piston 6, where the smaller flange 51 is spaced apart from the first piston flange 50 along the main longitudinal axis of the piston 6. Lip portions 32 of rods 33 are located in the gap between, and secured between the flanges 50, 51 of the piston 6. The rods 33 extend parallel to the main longitudinal axis of the piston 6 through apertures 49 (shown only in FIGS. 4 and 5) formed in an end cap 13 which is integral with the housing 40. An 'O' ring seal 39 seals the bore of the aperture 49 with respect to the outer surface of the rods 33. The outer most end of the rods 33 can abut against a piston lock ring 34 which is threaded to the housing 40.

A channel or bore 54 extends through the piston 6 along the main longitudinal axis of the piston 6, such that it extends from the throughbore 3 to the bore 42 of the housing 40. The pressure in the bore 42 of the housing 40 is therefore equalised with the pressure in the throughbore 3. Thus, significantly less force is required to move the piston 6 and associated ram 59 from the open to the closed configuration in order to close the throughbore 3 than would be required if the pressure in the throughbore 3 was greater than that in the bore 42 of the housing 40, as is normally the case.

A first hydraulic line quick connect coupling 65 having an inner bore is provided on the outer surface of the cylinder 12, where the inner bore of the coupling 65 is in fluid communication with an access port 66 provided in the sidewall of the cylinder 12 toward the outer most end thereof. A pressurised hydraulic line (not shown) is attached to coupling 65 in use, and in this manner pressurised hydraulic fluid can be injected through the access port 66 into the area of the hydraulic fluid chamber 14 between 'O' ring seal 52, 'O' ring seal 44 and 'O' ring seals 39.

A second hydraulic line quick connect coupling 67 having an inner bore is provided on the outer surface of the cylinder 12, where the inner bore of the coupling 67 is in fluid communication with an access port 68 provided in the sidewall of the cylinder 12 toward the inner most in use end thereof. A pressurised hydraulic line (not shown) is attached to coupling 67 in use, and pressurised hydraulic fluid can be injected through the access port 68 into the area of the hydraulic fluid chamber 14 between 'O' ring seal 29 (shown in FIG. 3 as sealing the inner bore of the cylinder 12 with respect to the piston 6) and 'O' ring seal 52 provided on the main piston flange 50.

An 'O' ring seal pack 45 seals the wellbore pressure within the well bore pressure chamber 42 from escaping into the first bore 14. A first vent channel 43 is optionally provided through the sidewall of the end cap 13 between the 'O' ring seal 44 and the 'O' ring seal pack 45, and serves to vent the wellbore pressure to atmosphere in the unlikely event that the 'O' ring seal pack 45 fails. A second vent channel 46 (shown on FIG. 9(*b*)) is optionally provided through the sidewall of the cylinder 12 between the 'O' ring seal 29 and an 'O' ring seal pack 47 (the inner most end of which sees wellbore pressure), and the second vent channel 46 also serves to vent the wellbore pressure to atmosphere in the unlikely event that the double 'O' ring seal 47 fails. In this manner, the wellbore pressure cannot pass into the hydraulic fluid chamber 14, and so cannot be transmitted back down the first or second hydraulic lines to the operator.

The lock ring 34 has an internal thread to engage a corresponding thread on the housing 40 and the lock ring 34 also has an external thread (opposite to the said internal thread) to engage with an internal thread of the sleeve 35. For this embodiment, the internal thread of the lock ring 34 is a right hand thread whilst the external thread of the lock ring 34 is a left hand thread, although it will be appreciated that in alternative embodiments the internal thread could be a left hand thread and the external thread could be a right hand thread. The benefit of using opposite threads is described below.

The external thread of the end cap 13 engaging with the inner thread of the sleeve 35 allows the sleeve 35 to also engage with the end cap 13 during transportation of the wireline BOP 1. This protects the rods 33 which would otherwise be exposed when in their open position, shown in FIG. 6. To facilitate this, the sleeve 35 is threadably engaged on the lock ring 34 so they can move with respect to each other. In use however, the sleeve 35 does not engage the end cap 13.

Apertures 36 are provided in the sleeve 35, to allow a handle (not shown) to be inserted through the apertures 36 in order to manually turn the sleeve 35.

In use, production fluids are recovered from the well (not shown) through flow lines (not shown) in a controlled manner.

Figure 3:
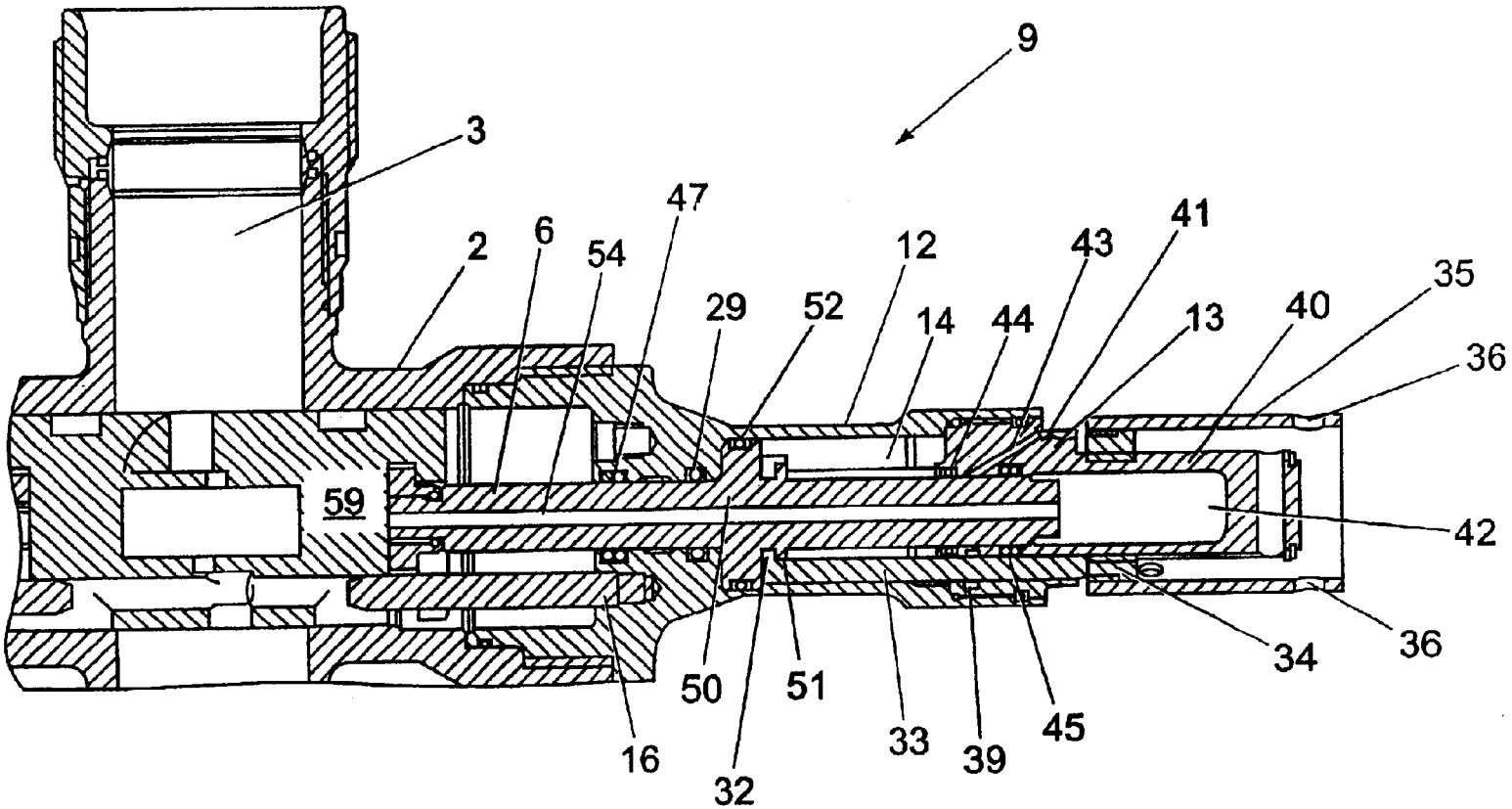
FIG. 3 is an enlarged cross-sectional view of an arm of the wireline BOP of FIG. 1.

In the event that the throughbore 3 requires to be closed, the ram 59 is hydraulically activated to close throughbore 3 (along with the opposite ram 58 shown in FIGS. 1 and 5), in a manner which will now be described. The hydraulic line coupled to the first coupling 65 is activated to inject pressurised hydraulic fluid through the first access port 66, and in so doing, acts upon the outer most face of the main piston flange 50 such that the piston 6 is forced inwardly (right to left as shown in FIG. 3) until it has reached its full stroke and is in the closed configuration.

The back up system is then operated in order to hold the rams 58, 59 in their closed position. The handle is inserted through apertures 36 of the sleeve 35 and the sleeve 35 is rotated with respect to the lock ring 34, away from the throughbore 3 of the wireline BOP 1 until the lock ring 34 and sleeve 35 lock with respect to each other due to a suitable block (not shown) provided on their mutually engaging threads.

Continued rotation of the sleeve 35 causes the lock ring 34 and sleeve 35 to rotate as one, back towards the throughbore of the wireline BOP 1 since the threads between the housing 40 and lock ring 34 are opposite to those between the lock ring 34 and sleeve 35. The lock ring 34 and sleeve 35 move toward the throughbore 3 until the front face of the lock ring 34 abuts with the rear or outer most ends of the rods 33. The piston 6 and ram are thereby secured in the closed position via the rods 33 by the lock ring 34. Therefore the lock ring 34 and sleeve 35 need to be able to move as one in order to move the lock ring 34 to back up the rods 33 and also to move with respect to each other in order to engage the sleeve 35 with the end cap 13 during transportation; the opposite threads on the lock ring 34 provide for this.

The rams 59–61 in the arms 9–11 are activated simultaneously in the same manner.

The channel 54 which balances the pressure between the throughbore 3 and the well bore pressure chamber 42 of the housing 40 reduces the strain on the rods 33 which would otherwise need to be far larger in diameter in order to cope with the pressure in the throughbore 3 acting on the ram 59 and piston 6. Furthermore, the hydraulic fluid force used to move the ram 59 between the open and closed configurations can be at a considerably lower force than conventional wireline BOPs, since the force only needs to be high enough to overcome the friction between the various seals and the wireline BOP body 2. As the skilled person will appreciate, this means that the size of the actuator assembly can be considerably reduced.

For certain embodiments of the invention, the lock ring 34 can be used to move the rams to close the throughbore 3 in the event of a hydraulic failure. This was impractical for previous wireline BOPs due to the pressure differential between the first and second ends of the actuator assembly which would resist movement of the lock ring 34.

In order to open the rams 59, the back-up system is removed by rotating the sleeve 35 in the opposite direction to that previously described, and the first hydraulic line connected to the first coupling 65 is de-activated such that the pressurised fluid is permitted to escape through the first hydraulic line. The hydraulic line coupled to the second coupling 67 is then activated to inject pressurised hydraulic fluid through the second access port 68, and in so doing, acts upon the inner most face of the main piston flange 50 such that the piston 6 is forced outwardly (left to right as shown in FIG. 3) until it has returned its full stroke to the open configuration.

Certain embodiments of the invention generally benefit from smaller components in particular smaller pistons and rods which reduce the material required and costs to produce the wireline BOP 1.

In certain preferred embodiments, the cross-sectional area of the piston 6 and 'O' ring seals 29, 47 and 44,45 are varied independently; i.e. the pair of 'O' ring seals 29 and 47 and the associated diameter of the piston 6 (to the left hand side of the first piston flange 50 in FIG. 3) may be of a greater or lesser diameter than the 'O' ring seals 44 and 45 and the associated diameter of the piston 6 (to the right hand side of the first piston flange 50 in FIG. 3) in order to create an unbalanced force in either the opening or closing direction of the actuator assemblies, as desired. In such embodiments, the pressure in the bore 3 and the bore pressure chamber 42 are still equalised, but the increased surface area of the piston 6 at the bore 3 or the bore pressure chamber 42 results in the unbalanced force.

In a further alternative embodiment, a pump (not shown) may be provided instead of the channel 54 in the piston 6 in order to vary the pressure in the bore 42 of the housing 40 so that it is close to or the same as the pressure in the throughbore 3.

In certain embodiments of the invention, the rods 33 perform two functions. The first, to provide a mechanical back-up to the piston 6, and the second to indicate to an operator the extent of the stroke of the piston 6.

Modifications and improvements may be made without departing from the scope of the invention. Those skilled in the art will realise that, although the embodiment hereinbefore described is employed in a wireline BOP valve, it could also be modified for use in other valves such as a drilling BOP or a coiled tubing BOP.

What is claimed is:

1. An apparatus capable of resisting the flow of fluids through a bore, the apparatus comprising:

at least one actuator assembly, the or each actuator assembly having a first and second end and being adapted to move between a first configuration wherein fluids are permitted to flow through the bore, and a second configuration wherein fluids are resisted from flowing through the bore, wherein the actuator assembly comprises a hydraulic fluid chamber and a well pressure chamber and wherein the first and second ends are each exposed to the pressure in the bore;

wherein a locking member is provided to abut with a portion of the actuator assembly when it is in the second configuration in order to resist movement of the actuator assembly from the second configuration to the first configuration, wherein the portion of the actuator assembly is coupled to the rest of the actuator assembly at a location within the hydraulic fluid chamber.

2. Apparatus as claimed in claim 1, further comprising a biasing arrangement adapted to bias the actuator assembly toward one of the first and second configurations; wherein the biasing arrangement comprises a piston with a first end and a second end, each end being sealed within a cylinder by first and second sealing mechanisms, and wherein the first sealing mechanism provides a smaller cross sectional sealing area than the second sealing mechanism.

3. An apparatus capable of resisting the flow of fluids through a bore, the apparatus comprising:

at least one actuator assembly, the or each actuator assembly having a first and second end and being adapted to move between a first configuration wherein fluids are permitted to flow through the bore, and a second configuration wherein fluids are resisted from flowing through the bore, wherein the actuator assembly comprises a hydraulic fluid chamber and a bore pressure chamber and wherein the first and second ends are each exposed to the pressure in the bore and wherein a locking member is provided to abut with a portion of the actuator assembly when it is in the second configuration in order to resist movement of the actuator assembly from the second configuration to the first configuration, wherein the said portion of the actuator assembly protrudes from the hydraulic fluid chamber.

4. An apparatus as claimed in claim 3, wherein the locking member is threadably engaged on a cylinder.

5. An apparatus as claimed in claim 4, wherein a sleeve is threadably mounted on the locking member and is rotatable in a first direction to engage a further portion of the cylinder or in a second direction to cause movement of the locking member toward the actuator assembly.

6. An apparatus as claimed in claim 5, wherein the locking member has an internal bread and an external thread, said internal thread being oppositely directed to said external thread.

7. An apparatus capable of resisting the flow of fluids through a bore, the apparatus comprising:

at least one actuator assembly, the or each actuator assembly having a first and second end and being adapted to move between a first configuration wherein fluids are permitted to flow through the bore, and a second configuration wherein fluids are resisted from flowing through the bore, wherein the or each actuator assembly comprises a hydraulic fluid chamber and a bore pressure chamber, wherein the first and second ends are each exposed to the pressure in the bore and wherein the actuator assembly comprises at least one rod assembly which extends from the hydraulic fluid chamber to a position in which it is visible from an outside of the apparatus.

8. An apparatus as claimed in claim 7, wherein a first end of the or each rod assembly is attached to the actuator assembly and a second end of the or each rod assembly is adapted to abut with a locking member.

9. An apparatus as claimed in claim 7, wherein the or each actuator assembly is provided in a cylinder, and the cylinder and actuator assembly combine to form the hydraulic fluid chamber and the bore pressure chamber.

10. An apparatus as claimed in claim 9, wherein the pressure in the bore and the pressure in the bore pressure chamber are equal.

11. An apparatus as claimed in claim 7, wherein the actuator assembly comprises first and second hydraulic fluid chambers, and wherein hydraulic fluid may be injected into either one of the first and second hydraulic fluid chambers to move the actuator assembly from the second configuration to the first configuration or from the first configuration to the second configuration respectively.

12. An apparatus as claimed in claim 11, wherein the actuator assembly comprises a piston, and a flange extends radially outwardly from the piston to separate the first and second hydraulic fluid chambers.

13. An apparatus as claimed in claim 7, wherein the or each actuator assembly comprises a throughbore closure device provided at its first end.

14. An apparatus as claimed in claim 9, wherein a channel is provided in the or each actuator assembly so that the bore is in fluid communication with the bore pressure chamber.

* * * * *